US005479751A

United States Patent [19]

White

[11] Patent Number: 5,479,751

[45] Date of Patent: Jan. 2, 1996

[54] METHOD AND APPARATUS FOR FABRICATION OF WOOD SUBSTITUTE CONTAINING CEMENT AND SYNTHETIC RESIN

[76] Inventor: James E. White, 4904 Cottonwood Dr., Hutchinson, Kans. 67502

[21] Appl. No.: 298,031

[22] Filed: Aug. 30, 1994

[51] Int. Cl.[6] ..... E04C 3/34

[52] U.S. Cl. ..... 52/309.12; 52/309.17; 52/DIG. 7; 52/DIG. 8; 52/DIG. 9; 52/738.1

[58] Field of Search ..... 52/DIG. 7, DIG. 8, 52/725, 727, 309.12, 309.17, DIG. 9; 106/802, 823, 724; 428/392

[56] References Cited

U.S. PATENT DOCUMENTS

| | | | |
|---|---|---|---|
| 1,486,208 | 3/1924 | Weber | 52/DIG. 7 X |
| 2,104,506 | 9/1935 | Coddington | 52/727 X |
| 2,372,048 | 6/1941 | Auxier | 52/DIG. 7 X |
| 2,491,487 | 7/1945 | Foulwetter | 52/DIG. 7 X |
| 3,177,902 | 4/1965 | Rubenstein | 52/DIG. 7 X |
| 3,583,119 | 6/1971 | Kann | 52/DIG. 8 X |
| 5,030,282 | 7/1991 | Matsuhashi et al. | 106/692 |
| 5,032,181 | 7/1991 | Chung | 106/717 |

*Primary Examiner*—Carl D. Friedman
*Assistant Examiner*—W. Glenn Edwards
*Attorney, Agent, or Firm*—Hovey, Williams, Timmons & Collins

[57] ABSTRACT

An improved wood substitute product (56) is provided having sawability and fastener-holding properties which approximate natural wood. The product (56) includes an outermost casing (20) preformed to a desired shape and filled with a cementitious fill material (55) including respective amounts of cement and synthetic resin foam. In fabrication procedures, the casing (20) is first formed as a hollow tubular body by roll forming, rotational molding or similar techniques, whereupon the body is temporarily capped and filled with the material (55). A filling device (28) is preferably employed for this purpose, which includes a pumping assembly (32) as well as an elongated horn (30), which is complemental with the casing (20).

9 Claims, 2 Drawing Sheets

FIG. 1.
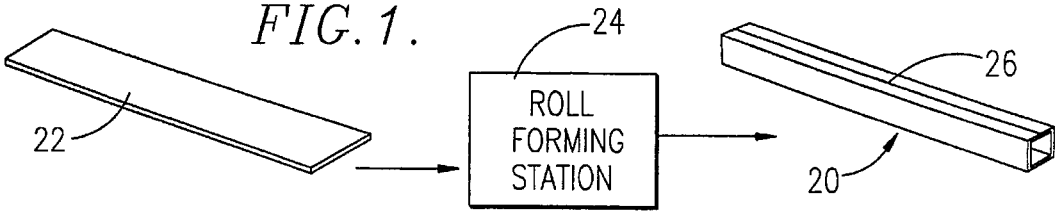
FIG. 2.
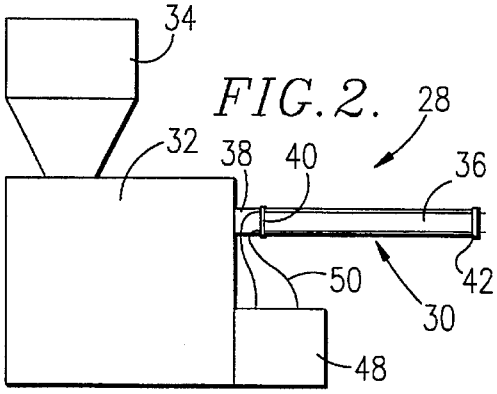
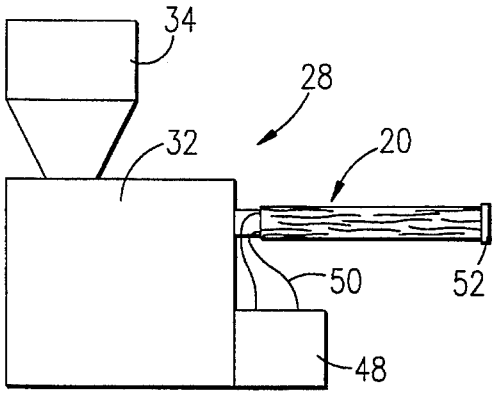
FIG. 3.
FIG. 4.
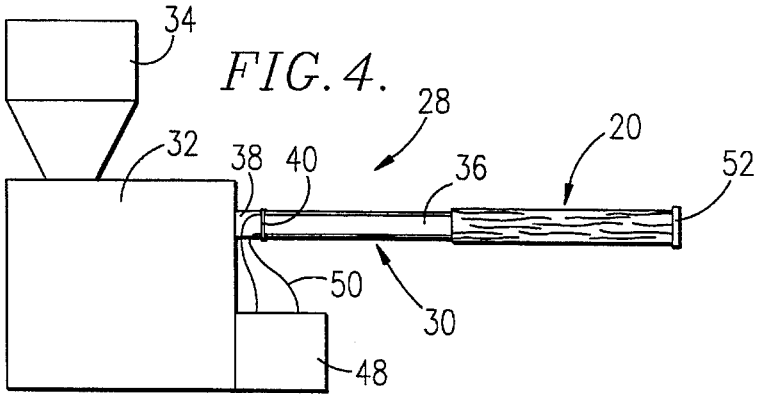
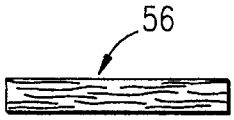
FIG. 5.
FIG. 6.
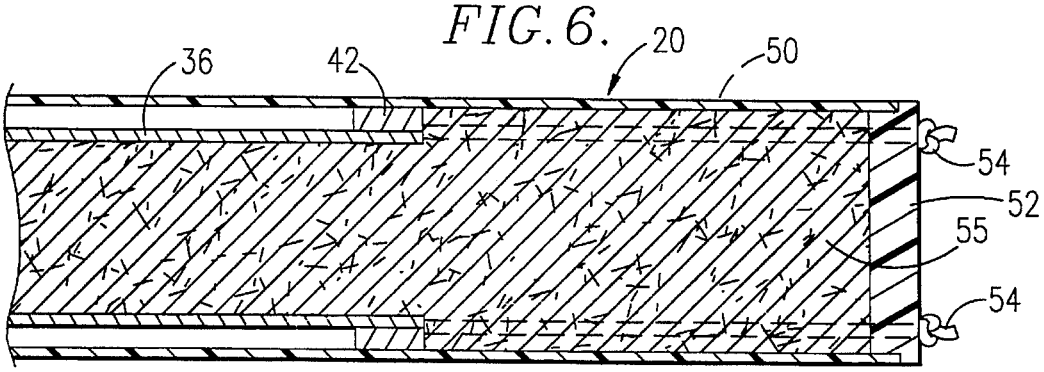

METHOD AND APPARATUS FOR FABRICATION OF WOOD SUBSTITUTE CONTAINING CEMENT AND SYNTHETIC RESIN

BACKGROUND OF THE INVENTION

1. Field of the Invention

The present invention is broadly concerned with an improved wood substitute product having many physical properties similar to that of wood (e.g., sawability, specific gravity and fastener retention) while being relatively inexpensive to fabricate and having a very long useful life. More particularly, it is concerned with such wood substitutes and methods for fabrication thereof, wherein the product includes an outermost, tubular casing with a cured fill including respective amounts of cement and synthetic resin foam; the presence of substantial amounts of synthetic resin foam in the cementitious fill has been found to give the wood substitute product many of the desirable qualities of wood.

2. Description of the Prior Art

The provision of acceptable, low-cost wood substitutes has long been a goal of many researchers in the art. It is known to provide wood substitutes formed entirely of synthetic resin materials such as polystyrene or polyvinyl chloride. However, these products are high in cost owing to the amount of synthetic resin employed, and are not price competitive with natural wood. Moreover, these products can degrade due to the effect of UV light or other environmental conditions. Finally, such synthetic resin products have only a limited ability to retain fasteners (particularly nails) and thus cannot be used in many applications where a wood substitute would otherwise be a viable alternative to natural wood.

Cement/fiber composites have also been used in the past to create high strength materials for specialized construction applications. For example, carbon fiber and synthetic resin fiber reinforced cement concretes are disclosed in U.S. Pat. Nos. 4,968,561, 5,030,282 and 5,032,181. However, these products are not useful as wood substitutes.

There is therefore a need in the art for a truly useful and cost-effective wood substitute which mimics the desirable properties of wood such as sawability, specific gravity and the ability to hold a variety of fasteners including nails.

SUMMARY OF THE INVENTION

The present invention overcomes the problems outlined above and includes an outermost, elongated, tubular casing filled with a cured material including respective amounts of cement and synthetic resin foam material. Preferably, the synthetic resin foam is present in the material in substantial excess as compared with the cement.

In preferred forms, the tubular casing is formed of a synthetic resin material such as polyvinyl chloride. However, other casing materials can also be employed, such as paper or metal, depending upon the environment of the desired end use.

The invention also provides a method of fabricating wood substitute products including the steps of first forming an elongated, tubular casing, typically by roll forming or other known techniques, followed by filling of the casing with an initially flowable cementitious material containing particulate synthetic resin foam, and allowing the flowable material to cure within the casing.

BRIEF DESCRIPTION OF THE DRAWINGS

FIG. 1 is a schematic representation of the initial step in a preferred process for the fabrication of a wood substitute product wherein an elongated sheet of synthetic resin material is roll formed and sealed to present an elongated tubular casing;

FIG. 2 is a schematic representation of a filler device useful for filling the tubular casing with cementitious fill;

FIG. 3 is a view similar to that of FIG. 2, but showing the tubular casing disposed over the outlet horn of the filler device and prior to actual filling of the casing;

FIG. 4 is a view similar to that of FIG. 3, but showing the casing during the filling operation;

FIG. 5 is a side elevational view of a completed wood substitute product in accordance with the invention;

FIG. 6 is an enlarged, fragmentary, sectional view illustrating the casing filling operation and depicting the use of a temporary end cap and elongated reinforcing fibers within the casing;

DETAILED DESCRIPTION OF THE PREFERRED EMBODIMENTS

Referring first to FIGS. 1–4 and 6, the preferred method of fabricating a wood substitute product in accordance with the invention is illustrated.

The initial step involves formation of an elongated, tubular, synthetic resin casing 20. Such is preferably accomplished by initial provision of an elongated sheet 22 of polyvinyl chloride siding material having a minimum thickness of at least about 0.010 inches, and more preferably from about 0.030–0.040 inches. Advantageously, one surface of this material is formed to present a simulated wood grain appearance. This sheet 22 is then conventionally roll formed in a roll forming station 24 in order to create the casing 20, in this case of substantially square cross-section. As illustrated in FIG. 1, the formed casing 20 presents an axial seam 26 in one face thereof, and the casing construction is completed by sealing the terminal edges of the sheet with a PVC adhesive to create a unitary casing body. In other forms of the invention, the casing 20 may be formed by other techniques, e.g., rotational molding.

Figure 8:
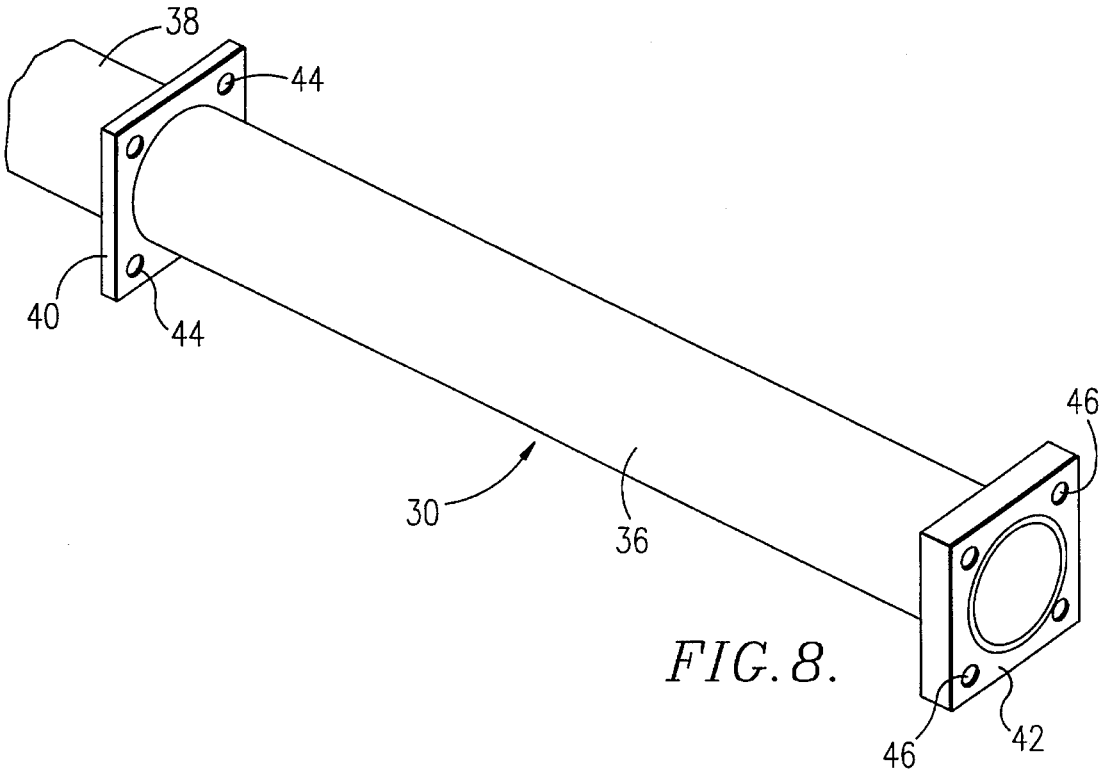
FIG. 8 is a perspective view of a stuffing horn used in the fabrication of wood substitute products.

FIG. 2 illustrates a pumping/stuffing device 28 for the filling of casing 20 with a cementitious fill. The device 28 includes an elongated, tubular stuffing horn 30 which may be of various cross-sections as explained hereafter, together with a pumping assembly 32 operably coupled with horn 30 for delivery of the fill through the horn. A hopper 34 is situated atop assembly 32 to allow introduction of cementitious material into the device 28. Referring specifically to FIG. 8, the horn 30 is illustrated in greater detail. As shown, the horn includes an elongated, tubular, round in cross-sectional delivery pipe 36 having the inner end 38 thereof operably coupled with pumping assembly 32. A pair of axially spaced, casing-supporting plates 40, 42 are secured to pipe 36 as shown. The plate 40 includes a total of four fiber-receiving apertures 44 each adjacent a corner of the plate 40. The plate 42 is positioned at the outermost delivery end of pipe 36 and includes four apertures 46 each positioned adjacent a respective corner of the plate 42 as shown. A supply 48 of reinforcing fiber is situated adjacent device 28 as shown, with four strands 50 of the fiber extending through corresponding pairs of apertures 44 and 46; thus, each of the strands 50 extends through a pair of aligned apertures 44, 46.

In the next fabrication step, an apertured end cap 52 is affixed to one end of casing 20, and the casing is slid over horn 30 until the cap 52 abuts or is closely adjacent to plate 42. At this point, the fibers 50 are passed through the end cap apertures and knotted as at 54 (see FIG. 6). This orientation of the casing 20 is best illustrated in FIG. 3.

Figure 7:
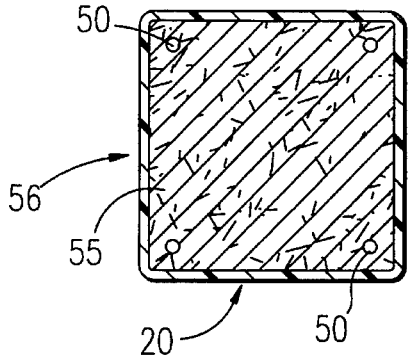
FIG. 7 is cross-sectional view of a substantially square wood substitute post in accordance with the invention.

At this point, the pumping assembly 32 is actuated in order to cause flowable cementitious material 55 to pass through pipe 36 and out the open end thereof. This causes the casing 20 to be moved outwardly during the filling process, as best seen in FIG. 6. During this process, it will be appreciated that the reinforcing strands 50 are withdrawn from supply 48 so that the strands extend the full length of the casing 20. As best seen in FIG. 4, as the filling procedure continues, the casing 20 ultimately moves off the end of horn 30. At this point, the filled casing 20 is manually removed from the device 28, and the ends of the strands 50 are cut. The knots 54 are likewise cut and cap 52 is removed. This creates the final filled casing depicted in FIG. 5. The filled casing can then be set aside to cure to create the final end product 56. As will be observed, the final end product 56 is completely filled with cementitious material 55, and with reinforcing strands 50 adjacent each corner of the product (see FIG. 7). Moreover, inasmuch as the starting sheet 20 had a preformed, simulated wood grain appearance, the outer surface of the product 56 has this desirable appearance.

It will be understood that the invention is in no way limited to the production of square products as heretofore described. For example, use of a differently configured stuffing horn can result in different cross-sectional shapes.

As indicated previously, an important aspect of the invention is the provision of a casing fill material comprising respective amounts of cement and synthetic resin foam material. Advantageously, the flowable material should include at least about 5% by volume cement and at least about 20% by volume synthetic resin foam therein; more preferably, the fill should have at least about 10% cement by volume and at least about 30% by volume synthetic resin foam. In addition, it is preferred to make use of an amount, generally at least about 3% by volume, of synthetic resin chips such as post-consumer waste recycled plastics, as well as a small amount on the order of 0.5% and above by volume of fiber such as straw, sisal or polypropylene. The single most preferred cementitious fill is made up of: (where all amounts are approximate and on a volume basis) 15% Portland cement; 54% polystyrene foam particles which will pass a 1/4 inch grid screen; 12% post-consumer waste recycled plastic chips; 3% straw, 1% cornstarch, and 15% water. In terms of ranges of materials, the starting fill has on an approximate volume basis, the following: from about 5–30% cement, most preferably about 10–20%; from about 20–70% synthetic resin foam, most preferably about 30–60%; from about 3–20% synthetic resin chips, and most preferably about 5–15%; from about 0.5–15% fiber, and most preferably about 1–10%; from about 0–4% cornstarch, more preferably from about 1–2%; and from about 5–30% water, most preferably about 10–18%.

The products of the invention can be used to good effect as wood substitutes. They have in preferred forms a specific gravity which simulates natural wood, and moreover are soluble and hold a variety of fasteners including nails. Given the fact that the products have an outer synthetic resin casing, they are remarkedly weather resistant, particularly when the casing is formed from siding material.

I claim:

1. A wood substitute product comprising an elongated, tubular, preformed casing filled with a cured material comprising respective amounts of cement and synthetic resin foam material, said synthetic resin foam material being dispersed throughout the cured material, the synthetic resin foam material being present in a volumetric amount greater than the volumetric amount of said cement.

2. The product of claim 1, said casing being formed of a material selected from the group consisting of synthetic resin, paper and metal.

3. The product of claim 2, said casing being formed of polyvinyl chloride having a thickness of at least about 0.010 inch.

4. The product of claim 2, said thickness being from about 0.03–0.04 inch.

5. The product of claim 1, said casing having the outer surface thereof formed to present a simulated wood grain.

6. The product of claim 1, said cured material having at least about 5% cement by volume and at least about 20% by volume synthetic resin foam therein.

7. The product of claim 1, said cured material including at least about 10% cement by volume and at least about 30% by volume synthetic resin foam.

8. The product of claim 1, said cured material including at least about 3% by volume of post-consumer waste recycled synthetic resin chips therein.

9. The product of claim 1, including a minor amount of reinforcing fiber within said cured material.

* * * * *